United States Patent [19]

Greever et al.

[11] 4,102,027

[45] Jul. 25, 1978

[54] SPINE FINNED TUBE

[75] Inventors: James E. Greever, Dewitt, N.Y.; James P. Schafer, Minnetonka, Minn.

[73] Assignee: Carrier Corporation, Syracuse, N.Y.

[21] Appl. No.: 689,774

[22] Filed: May 25, 1976

[51] Int. Cl.[2] ..... B23P 15/26

[52] U.S. Cl. ..... 29/157.3 AH; 165/182; 29/DIG. 1; 156/290; 156/291; 156/324

[58] Field of Search ..... 29/157.3 AH, 157.3 A, 29/157.3 B; 156/290, 291, 324; 165/182; 29/DIG. 1

[56] References Cited

U.S. PATENT DOCUMENTS

| | | | |
|---|---|---|---|
| 1,689,568 | 10/1928 | Wade | 29/157.3 AH |
| 3,548,488 | 12/1970 | Habdas | 29/157.3 AH |
| 3,688,375 | 9/1972 | Venables | 29/157.3 AH |
| 4,025,681 | 5/1977 | Donnelly et al. | 156/291 |

FOREIGN PATENT DOCUMENTS

| | | | |
|---|---|---|---|
| 1,329,698 | 5/1963 | France | 29/157.3 AH |
| 226,175 | 7/1925 | United Kingdom | 29/157.3 AH |
| 833,485 | 4/1960 | United Kingdom | 29/157.3 AH |

*Primary Examiner*—C.W. Lanham
*Assistant Examiner*—V. K. Rising
*Attorney, Agent, or Firm*—J. Raymond Curtin; Robert P. Hayter

[57] ABSTRACT

A heat exchanger tube comprising a primary tubular element for carrying a heating or cooling medium and a secondary heat transfer surface spirally wound about the tubular element. The heat transfer surface is formed in a U-shaped configuration with its base being wound in metal-to-metal contact against the tube surface and the two legs thereof extending radially from the base. Each leg, in turn, is provided with a plurality of slits extending inwardly from the extreme edge thereof to create a dense population of relatively thin spine-like fins radiating from the tube. A meniscus of adhesive is formed between the legs and the surface of the tube which secures the base of the fin strip in metal-to-metal contact against the tube surface and also supports the individual spine-like fins in a radially extended position. In a further embodiment of the invention, the exposed surfaces of the primary and secondary elements are coated with a thin layer of adhesive to protect the tube from corrosion.

11 Claims, 3 Drawing Figures

SPINE FINNED TUBE

BACKGROUND OF THE INVENTION

This invention relates to an improved heat exchanger tube and, in particular, to a heat exchanger tube having a dense population of spine-like fins mounted thereon in a spiral configuration.

More specifically, this invention relates to a heat exchanger tube made up of a primary tubular element for carrying a heating or cooling medium and a secondary heat transfer surface spirally wound about the tube having a multitude of thin spine-like fins protruding therefrom for transferring energy between the heating or cooling medium and air passing over the tube. The spines or fins are separated from each other throughout their entire length by an air gap that increases progressively from the base of the heat transfer surface to the tip of each spine. The tube's resistance to air is thus minimized making the tube well suited for use in air conditioning equipment or the like. The structure of the spine finned tube also minimizes the possibility of condensate freezing upon the tube. Moisture forming on the tube is directed downwardly by the spines and, because of the surface tension involved, is rapidly released by the tube. It should be further noted that a single section of wrapped fin tube can be conveniently formed into any number of shapes to produce a heat exchanger of almost any desired geometry that is easy to assemble and which eliminates costly components, such as tube return bends or the like, normally found in exchangers of a more conventional construction, and which are soldered or brazed into position.

Although, as pointed out above, many advantages are associated with a wrapped fin tube, this type of device has not as yet been widely utilized in the industry primarily because of the many difficulties associated with tube fabrication. This is particularly true where the primary and secondary tube elements are formed of aluminum or other materials that are difficult to join.

Heretofore, the secondary spine finned element has been joined to the primary tubular element by either a metal bonding process, such as welding, soldering, brazing, or the like, or adhesive bonding. The metal bonding techniques generally require special, relatively expensive, equipment to join the components. Furthermore, most metal-to-metal bonding processes invariably expose the components to high temperatures which can warp or thermally damage the parts. Adhesive bonding, on the other hand, is typically achieved by covering the outer surface of the primary tubular element with an adhesive coating and then wrapping the secondary fin element over the coated tube. A thermal resistance, i.e., the adhesive layer, is thus introduced into the critical region between the fin strip and the exchanger tube through which energy in transit must pass. Generally, this region represents a bottleneck in the heat transfer system and any impediment to passage of energy through this region will, of course, reduce the efficiency of the heat exchanger tube.

SUMMARY OF THE INVENTION

It is therefore an object of the present invention to improve thin finned tubes as employed in heat exchangers.

Another object of the present invention is to securely bond a spiral wrapped fin strip to a tubular member with an adhesive so that the base of the strip is maintained in positive metal-to-metal contact against the tube surface.

A further object of the present invention is to provide a spiral wrapped spine fin tube having excellent corrosion resisting characteristics.

Yet another object of the present invention is to provide means for conveniently bonding a thin gauged aluminum heat transfer surface to an aluminum tube.

These and other objects of the present invention are attained by a heat exchanger tube consisting of a primary tubular element for carrying a heating or cooling substance and a thin gauged secondary heat transfer surface spirally wrapped about the tube in intimate metal-to-metal contact therewith having a dense population of spine-like fins radiating outwardly therefrom, a meniscus of adhesive extending between the spinelike fins and the tube surface for securing the secondary heat transfer surface in metal-to-metal contact against the tube and supporting the fins in a radially extended position. In a further embodiment of the invention, a thin layer of adhesive is also coated upon the exposed surface of the primary and secondary tube elements to provide corrosion resistant lamina.

BRIEF DESCRIPTION OF THE DRAWINGS

For a better understanding of the present invention, as well as other objects and further features thereof, reference is had to the following detailed description of the invention to be read in connection with the accompanying drawings, wherein.

DESCRIPTION OF THE PREFERRED EMBODIMENT

Figure 1:
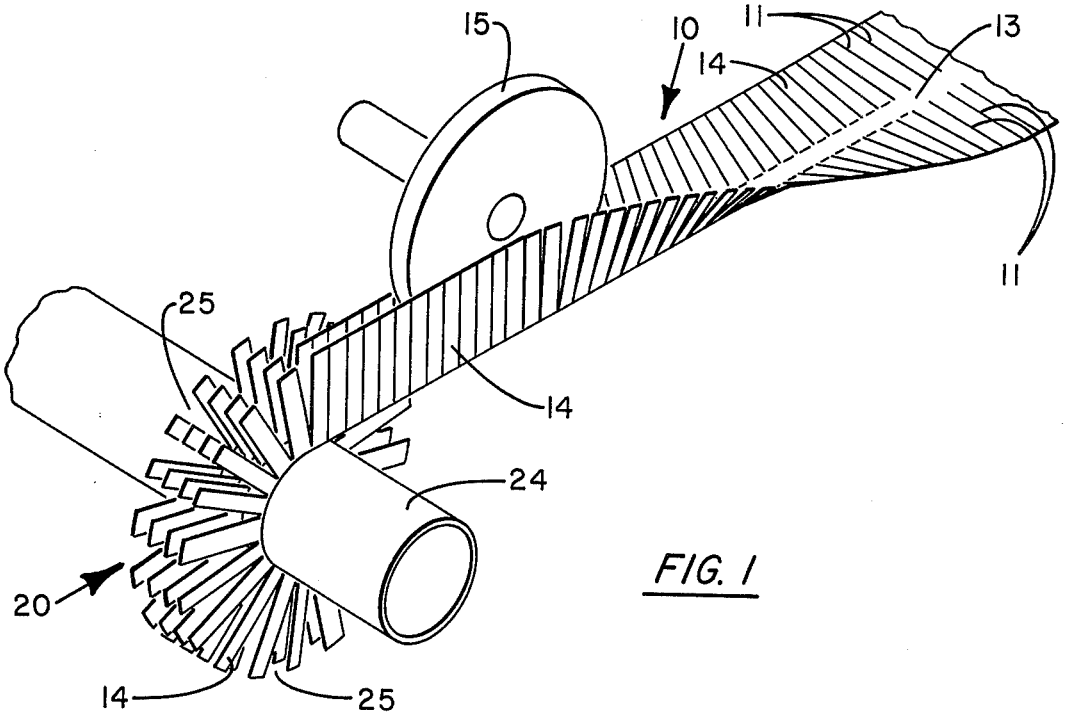
FIG. 1 is a partial perspective view illustrating the formation and winding of a secondary heat transfer surface upon a primary tubular element.

In carrying out the present invention, a thin gauged planar strip of material 10 having good heat transfer properties is provided with a series of slits 11 extending inwardly from each side of the sheet as illustrated in FIG. 1. The cuts or serrations terminate at the backbone 13 of the sheet so as to form laterally extended spine-like fin segments 14. The cut strip is then passed through one or more roller dies, as for example, die 15, that are specifically contoured to turn the fins upwardly on each side of the backbone to generate a continuous fin strip 20 of U-shaped cross-sectional form having a relatively flat base 16 and two parallel dependent legs 17, 18 containing the spine-like fins 14.

Upon the formation of the U-shaped element, the strip is spirally wrapped about a tubular element 24 at a predetermined helix so that the backbone or base 16 of the strip seats in contact against the outer surface of the tube. As the fin strip is wrapped about the tube, it is tensioned to insure that a positive metal-to-metal contact is maintained between the primary and secondary tube forming elements. As best seen in FIG. 1, the fin strip, which contains the two rows of extended fins, is deformed as it is wound over the tube causing the spine-like fins to spread out radially from the center of the tube. The individual spines or fins are thus separated from each other by an air gap 25 that increases gradually from the base of the fin strip to the outer extremities of the individual spines.

Figure 2:
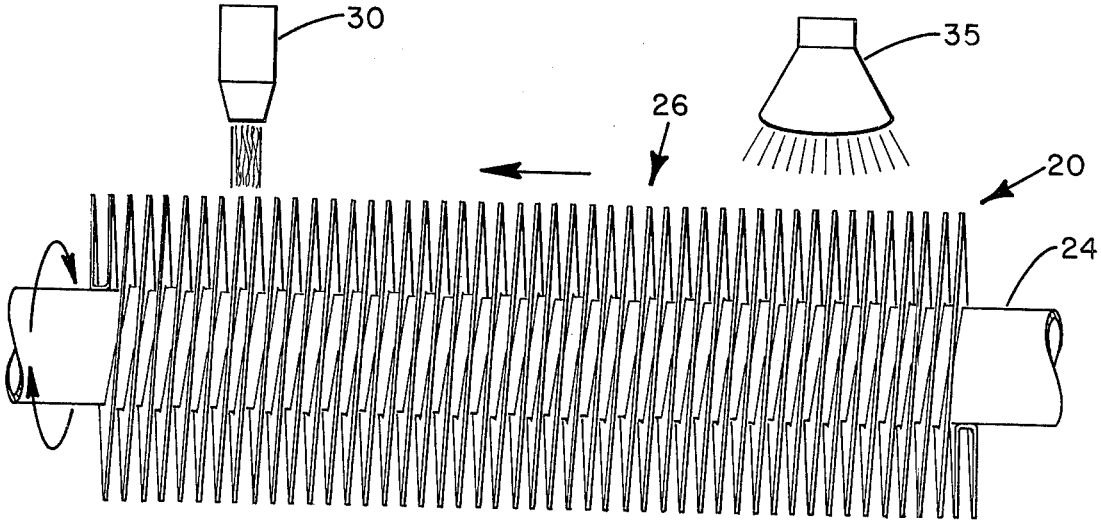
FIG. 2 is also a partial view illustrating the application and curing of an adhesive material upon the tube surface.

As best seen in FIG. 2, the fin strip can be continuously wound about the tubular member to produce a finned tube 26 of almost any desired length. In practice, the lead of the helix at which the fin strip is wound about the tube is preferably equal to the lateral distance between the two parallel legs of the fin strip. The spiral wound rows of fins supported upon the tube are thus evenly spaced along the length of the tube to produce a uniform and highly dense spine population thereupon. The dimensions of the individual fins are selected so as to maximize the surface area presented to the air passing over the tube, while at the same time, minimizing the pressure drop over the tube. Depending upon the operating conditions involved and whether the exchanger is to be used as a condenser or an evaporator, the width of the fins can be between 0.020 and 0.100 inch.

Figure 3:
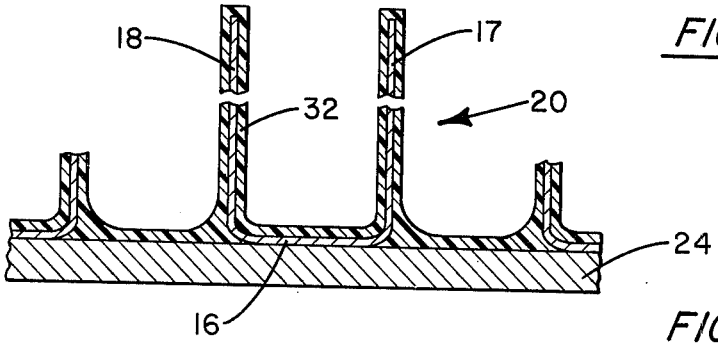
FIG. 3 is a partial sectional view showing a typical cross section taken through the heat exchanger tube illustrated in FIGS. 1 and 2.

With the fin strip wrapped about the tube, the tube is placed in a lathe-like fixture and turned below a nozzle 30 that is arranged to spray a curable adhesive over the exposed surfaces of the tube. Alternatively, the adhesive can be simply allowed to flow from a spigot or tap over the spined tube. The nozzle (or nozzles) is arranged directly over the wound tube and in this position will permit the adhesive to coat the fin tube at a controlled rate as it is advanced from the winding operation. A measured quantity of adhesive is thus applied to the tube to coat the exposed tube surfaces with a thin layer 32 of adhesive which is shown exaggerated in FIG. 3 for illustrative purposes. As the tube rotates, any excessive adhesive which might have been applied to the tube is caused to flow down the radially extended spines and eventually released leaving behind a relatively uniform coating.

Simultaneously therewith, the adhesive automatically moves up each leg of the strip and outwardly along the tube surface so as to provide a meniscus on both adhesive sides of the fin tube contact area along the length of the strip. This double fillet thus serves to bond the secondary fin strip in metal-to-metal contact against the primary tube and also supports the individual fins in a radially extended position. As can be seen, the adhesive in the meniscus also has the ability to flow beneath the fin strip base to fill any air gaps or voids thus preventing foreign material, particularly corrosion inducing materials, from being collected between the strip and the tube. By tensioning the strip against the tube, the adhesive is prevented from penetrating into the metal-to-metal contact region. Accordingly, when the adhesive is cured, the secondary fin strip is securely held in contact against the tube to provide for an efficient transfer of energy therebetween.

Preferably, the exposed surfaces of both the tube and the fin strip are coated with a thin layer of adhesive about 0.0007 inch thick. As noted, this coating acts as a thermal resistance in the system. However, sufficient fin area is provided to accommodate for this added resistance so that the overall efficiency of the tube is not impeded.

Positioned behind the nozzle in relation to the wound fin tube's path of travel is a radiant lamp 35, or other heat source, for rapidly curing the adhesive that has been sprayed upon the tube surface. Any suitable adhesive capable of being cured by exposure to radiant energy can thus be employed in the practice of the present invention. The lamp, or other heat source, is arranged directly in line with the path of travel of the wound fin tube to treat the coated surfaces of the tube rotating thereunder. A sufficient distance is maintained between the lamp, or other heat source, and the nozzle to permit any excessive adhesive sprayed upon the tubular surface to be completely drained from the tube prior to its being treated with radiant energy. Also as an example, the linear rate at which the fin tube moves can be coordinated with the cure cycle and a series of lamps employed which will permit a complete adhesive cure as a function of tube length per minute requirements.

Although a spraying process is herein utilized to apply the coating to a finned tube, the present invention is not necessarily limited to this particular coating technique. A coated heat exchanger tube can be similarly fabricated by dipping the finned tube into a bath of adhesive material and, upon removal, permitting the coated tube to drip-dry for a short period of time to release excessive adhesive therefrom prior to treating the tube with radiant energy. Similarly, when the adhesive is formed of a heat sensitive material, the adhesive can be conveniently cured by an oven drying process, or the like. Regardless of the method employed, it has been found that a fin strip comprising a base element capable of being wound upon a tube and at least one finned leg dependent upon the base that is turned outwardly in the manner herein described, will automatically form a meniscus at the juncture of the leg to the base and the outer surface of the tube for securing the fin strip to the tube and supporting the spines in a radially extended position.

While this invention has been described with reference to the structure herein disclosed, it is not confined to the details as set forth, and this application is intended to cover any modifications or changes as may come within the scope of the following claims.

What is claimed is:

1. A method of producing a heat exchanger tube having an aluminum component including the steps of slitting a flat elongated sheet of thin gauge material laterally inwardly from both edges thereof to form uniformly spaced fins along the edges of said sheet, bending the fins to a position substantially perpendicular to the plane of the sheet so as to form a U-shaped member having two substantially parallel rows of fins extending upwardly from the base thereof, wrapping the base of the U-shaped element about a tube to provide continuous contact between the base and the outer surface of the tube whereby the fins extend radially outwardly from the tube, establishing a meniscus of adhesive material along both sides of the fin member at the point of contact between the fin member and the tube surface whereby the integrity of the metal-to-metal contact between the base of the fin and the tube surface is preserved, and curing the adhesive to securely bond the fin member to the tube surface.

2. The method of claim 1 wherein the finned member is tensioned as it is wrapped upon the tube with sufficient force to insure continuous metal-to-metal contact between the base of the member and the surface of the tube along the entire length of the wrap.

3. The method of claim 2 wherein the viscosity of the adhesive bonding the finned member to the tube surface is sufficiently high so that the adhesive cannot penetrate the metal-to-metal contact maintained between the finned member and the tube surface.

4. In the process for producing a heat exchanger tube of the type wherein a finned member is formed in a U-shaped configuration with two parallel rows of fins extending outwardly therefrom and the finned member is spirally wound upon a tube to produce a metal-to-metal contact between the base of the finned member and the surface of the tube, the improvement comprising spraying the exposed surfaces of the finned member and the tube with an adhesive material whereby a meniscus of adhesive material is formed along the sides of the finned member and the tube surface, and curing the adhesive to secure the finned member to the tube.

5. The process of claim 4 wherein the resin is cured by heating the finned member and the tube and further including the step of air drying the tube prior to heating whereby excessive adhesive is removed therefrom.

6. The process of claim 4 wherein the finned tube is coated by spraying a heat sensitive adhesive over the spiral wound tube and the adhesive is cured by directing energy from a radiant source upon the adhesive coated tube.

7. The method of claim 4 wherein the coating is formed by flowing the adhesive over the tube.

8. A tube having an aluminum component for use in a heat exchanger including an elongated tubular member, a fin strip having a base section and a finned section extending from the base, the strip being wound about the tubular member with the base of the strip tensioned against the surface of the tube to provide intimate metal-to-metal contact therebetween and the fins extending radially from the tube, a thin layer of adhesive material covering the exposed surface of the strip and the tube to form a protective coating thereover, and a continuous meniscus of adhesive along both sides of the strip for securing the strip in contact with the tube surface and supporting the finned elements in a radial direction.

9. The tube of claim 8 wherein the fin strip is U-shaped in cross section with two parallel rows of fins extending upwardly from the common base and a meniscus of adhesive extending upwardly from the base to support each individual fin substantially perpendicular to the base.

10. The tube of claim 9 wherein the adhesive coating is sprayed on the exposed surfaces of the finned strip and the tube, is of the same material as the adhesive in the meniscus.

11. The tube of claim 10 wherein said material is a heat curable adhesive.

* * * * *